United States Patent [19]

Rockerath et al.

[11] 4,154,177

[45] May 15, 1979

[54] BUTTON FEEDING AND ORIENTING SYSTEM FOR SEWING MACHINES

[75] Inventors: John L. Rockerath; Harold J. Schreck, both of Utica, N.Y.

[73] Assignee: Cluett, Peabody & Co., Inc., New York, N.Y.

[21] Appl. No.: 781,645

[22] Filed: Mar. 28, 1977

[51] Int. Cl.[2] ..... D05B 3/22

[52] U.S. Cl. ..... 112/113

[58] Field of Search ..... 112/113, 110, 114, 104, 112/105, 106, 115, 276, 67

[56] References Cited

U.S. PATENT DOCUMENTS

| | | | |
|---|---|---|---|
| 2,722,184 | 11/1955 | Sweet | 112/276 |
| 2,764,112 | 9/1956 | Happe | 112/276 X |
| 3,127,857 | 4/1964 | Medoff et al. | 112/113 |
| 3,359,931 | 12/1967 | Miller et al. | 112/276 X |
| 3,541,982 | 11/1970 | Marjorie | 112/276 |
| 3,633,524 | 1/1972 | Hoffsommer et al. | 112/113 |
| 3,807,328 | 4/1974 | Lombardo | 112/113 |
| 3,863,579 | 2/1975 | Rockerath et al. | 112/113 |
| 3,889,612 | 6/1975 | Hughes et al. | 112/113 |
| 3,931,775 | 1/1976 | Zaruba | 112/113 |

*Primary Examiner*—H. Hampton Hunter

[57] ABSTRACT

The disclosure is directed to improvements in automatic mechanisms for feeding properly oriented buttons to the sewing station of a sewing machine, in preparation for sewing on a garment. The system utilizes a highly simplified pneumatic actuating system for both feeding and orienting the buttons. The system of the invention is arranged to accommodate a multiplicity of mechanical operations involved in button feeding and orienting, utilizing a simple arrangement of two pneumatic actuators, which are energized in timed sequence by pulses of air derived from operation of the sewing machine. In one of its most advantageous forms, the system of the invention derives the necessary timed energizing pulses of air from control air cylinders which form part of the basic sewing machine mechanism itself. Thus, adaptation of a conventional industrial sewing machine to incorporate the button feeding and orienting system may be accomplished in a highly simplified and economical manner.

12 Claims, 7 Drawing Figures

FIG.6
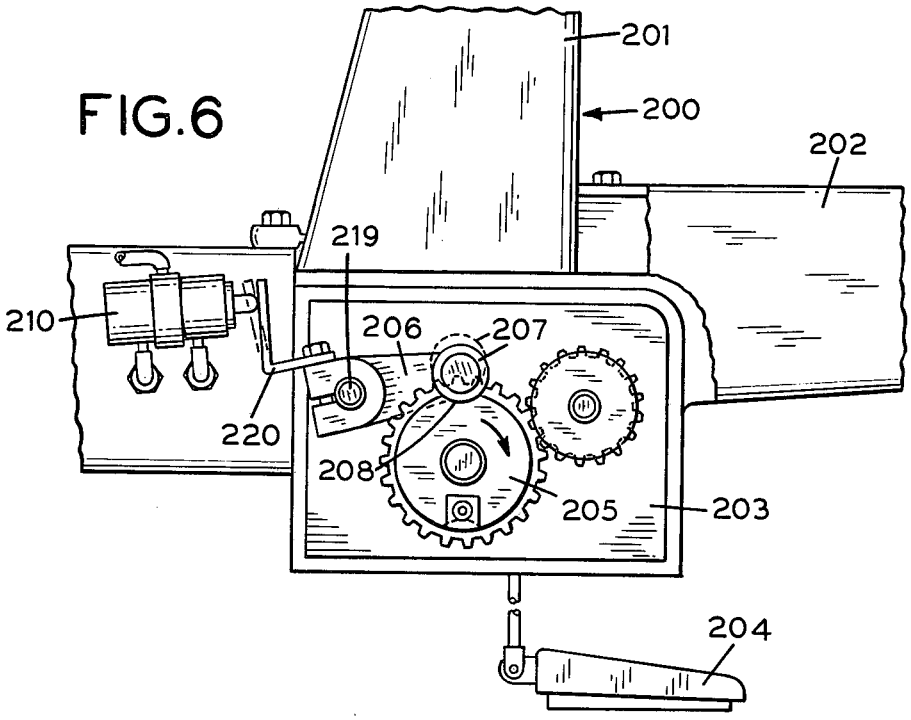
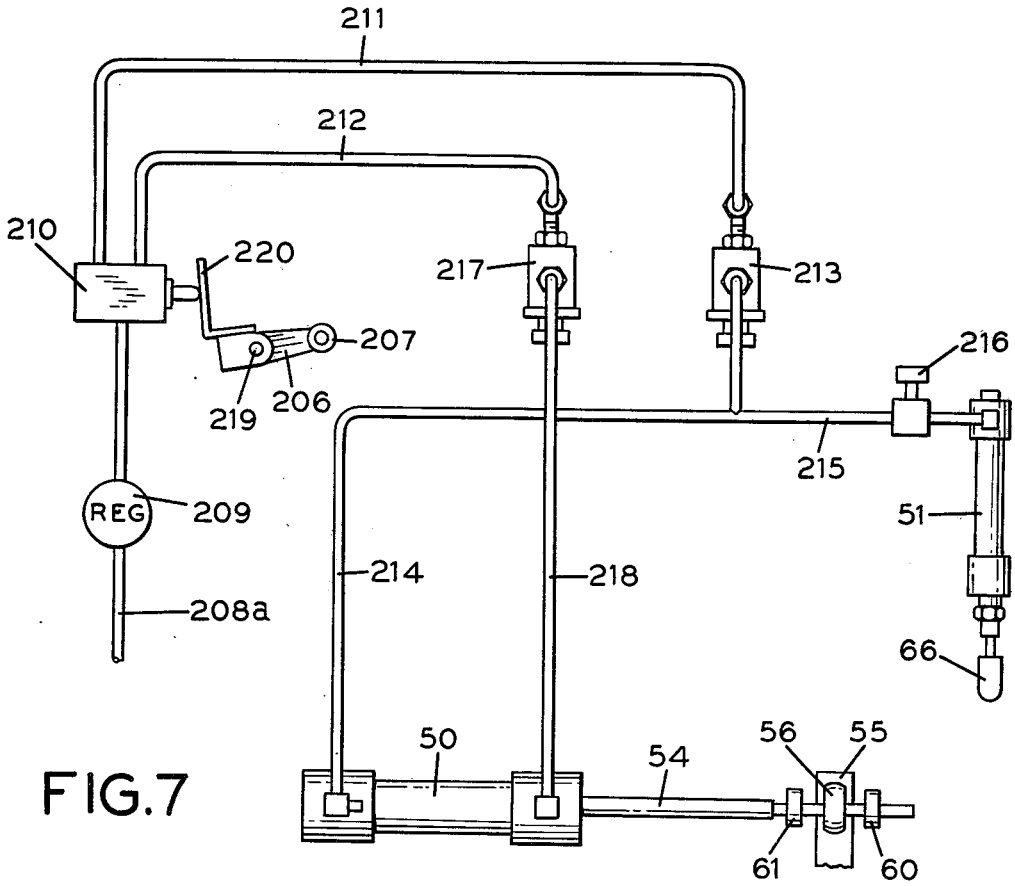
FIG.7

BUTTON FEEDING AND ORIENTING SYSTEM FOR SEWING MACHINES

BACKGROUND AND SUMMARY OF THE INVENTION

The present invention is closely related to and represents an improvement over our prior U.S. Pat. No. 3,863,579. That patent is directed to an improved mechanism, for attachment to a conventional industrial sewing machine, for feeding oriented buttons to a sewing station for securement to a garment. The mechanism of our prior patent is arranged to be mounted on a conventional sewing machine and to be mechanically actuated by a cam mechanism driven from the sewing machine drive, enabling the auxiliary mechanism to be actuated through a predetermined series of steps involved in the button feeding and orienting operation.

In accordance with the present invention, the button feeding and oriented system of our prior patent is improved and made more simple and economical by incorporating an improved form of actuating system for the button feeder, which is pneumatically, instead of mechanically actuated. By utilizing the new form of pneumatic actuation, instead of a mechanical association with the sewing machine, not only is the mechanism itself simplified, but its attachment to and incorporation with the sewing machine is rendered much more simple and economical. In this respect, it is contemplated that, while the button feeding and orienting mechanism will be in the nature of a permanent or semi-permanent attachment to the sewing machine, important savings in the equipment cost may be realized by minimizing the modifications required to be made to an otherwise standard commercial sewing machine in order to accept the button mechanism.

In accordance with one particularly advantageous feature of the invention, the new button mechanism is arranged to be incorporated in a standard commercial sewing machine of a type provided in the first instance with a pair of controllably sequenced pneumatic cylinders, which are associated with the raising and lowering of the presser foot and the commencement and termination of the sewing cycle. The button feeding and orienting system of the present invention is so arranged and constructed that the pneumatic cylinders employed in the mechanism are actuated by, in effect, simply tapping off of the fluid chambers of the main air cylinders incorporated in the sewing equipment itself. Thus, as the primary sewing machine cylinders are pressurized and exhausted in the course of a cycle of sewing operations, the primary control pressures are utilized in a unique and advantageous manner to effect properly timed actuation of the button feeding and orienting mechanism. In this manner, a rather complex series of operations involved in the button feeding and orienting are accomplished and, in addition, are properly synchronized with the sewing cycle, in an extraordinarily simplified, economical and reliable manner.

In another form of the invention, adapted specifically for incorporation with a different form of commercial sewing machine, not provided with primary air actuators, a unique and highly simplified pneumatic valving arrangement, having a mechanically timed association with the sewing cycle, is provided for effecting the desired sequence of operations of the button feeding and orienting mechanism.

For a more complete understanding of the above and other features and advantages of the invention, reference should be made to the following detailed description of preferred embodiments of the invention, and to the accompanying drawing.

DESCRIPTION OF THE DRAWING

FIG. 6 is a fragmentary elevational view illustrating the manner in which a modified form of the system of the invention is incorporated in a standard sewing machine not having pneumatic actuation.

FIG. 7 is a simplified schematic piping diagram of the button feeding and orienting mechanism incorporated with the sewing machine of FIG. 6.

DESCRIPTION OF PREFERRED EMBODIMENTS

Figure 1:
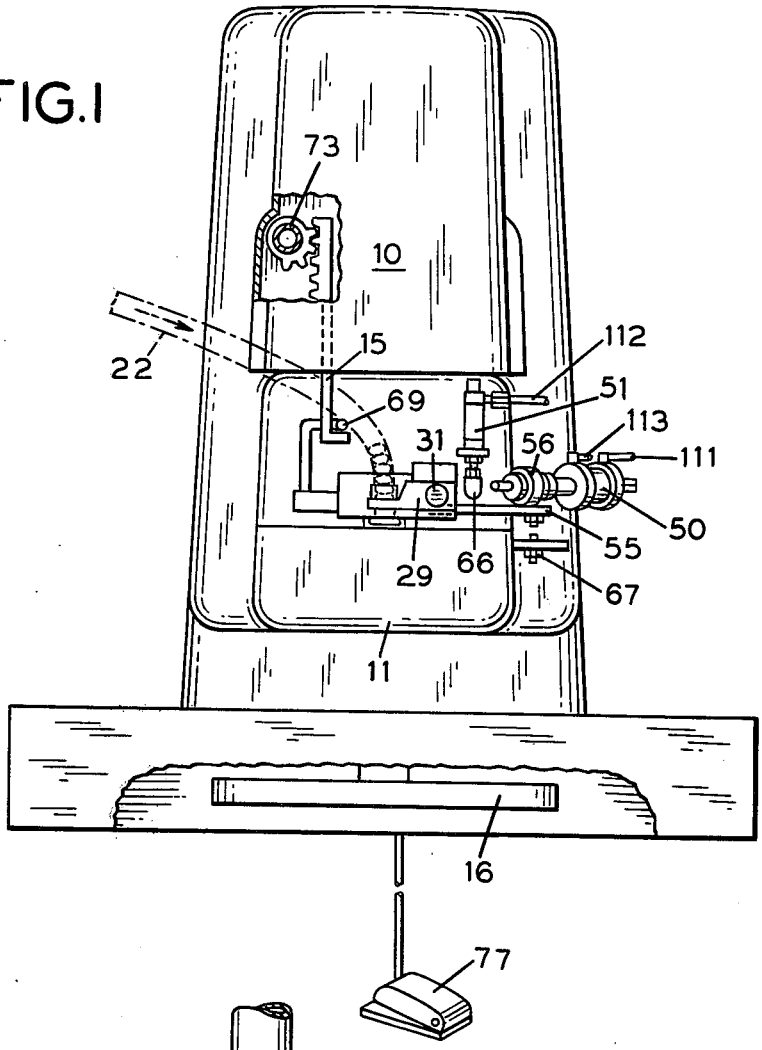
FIG. 1 is a front elevational view of a conventional, commercial sewing machine incorporating the improved button feeding and orienting system of the invention.

Referring now to the drawing, and initially to FIGS. 1–4 thereof, the reference numeral 10 designates in a most general way a typical commercial industrial sewing machine. By way of example, the sewing machine 10 may be a Singer Model 421, W307BA industrial type machine, which includes a base 11, pedestal 12, overhanging arm 13, needle 14 and presser foot support 15. A sewing machine of the type designated is typically arranged for operation in cycles, by means of a suitable control cam (such as indicated at 16). By means to be further described, when a sewing operation is commenced, as by actuation of a foot control valve or the like, a cycle of sewing is commenced during which, in a conventional machine, the presser foot is lowered onto the work and sewing is commenced and continued until the control cam 16 has completed a cycle, after which the sewing mechanism is disengaged from the drive motor and the presser foot is raised to permit removal of the work.

The illustrated machine is modified from its standard commercial version by attachment of a button feeding and orienting device of the general type described in our prior U.S. Pat. No. 3,863,579. To this end, a clamping spring 17 is mounted adjacent the sewing machine pedestal 12 and extends forward toward the sewing station. At its forward end, the clamping spring 17 mounts a button feeding bracket 19, which is provided with an open-ended guide slot 20 of a size suitable to receive buttons 21 of a predetermined size. The buttons 21 are supplied from a suitable means, such as a Syntron-type feed hopper (not shown), which discharges the buttons one by one down through a hollow chute, formed by a spring-like member 22.

At the outer end of the button feed bracket 19, there is a button clamp section 23 mounted on a spring 24 and provided with an arcuate recess 25 for gripping a button in the sewing position and holding it while a sewing operation is performed to secure the button to an underlying section of fabric.

As set forth more particularly in our before mentioned patent, a button in the load position L is arranged to be engaged by a plurality of downwardly extending short pins (not shown) which are adapted to enter the holes 27 in the button. The pins are mounted on a rotatable pinion 28 supported in a feeding head 29 and driven by a gear 30, which is also mounted in the feeding head.

Figure 3:
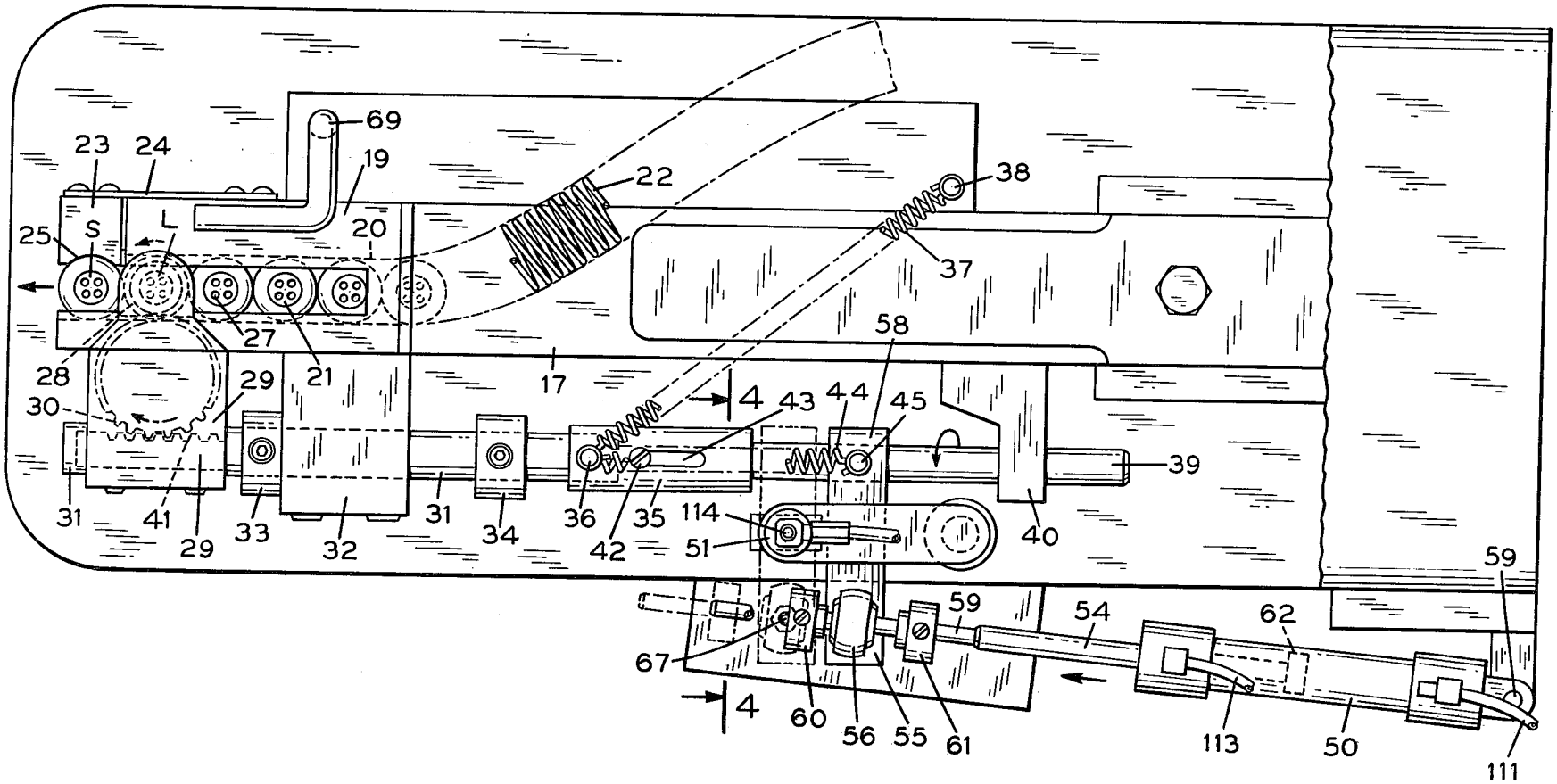
FIG. 3 is a top plan view illustrating the button feeding and orienting mechanism of the invention.

As illustrated particularly in FIG. 3, the feeding head 29 is secured in fixed relation to a support tube 31, which is mounted for limited axial sliding and rotating movement in a bearing block 32. Stop collars 33, 34 are fixed to the support tube 31 and serve to limit the extent of its sliding movement. When the forward collar 33 engages the block 32, the feeding head 29 is stopped in the load position L; when the rearward stop collar 34 engages the block 32, the feeding head is located in the sewing position S.

A short sleeve 35 is fixed to the end of the support tube 31, and a pin 36 extending radially from the sleeve engages one end of a tension spring 37. The other end of the spring is engaged by a pin 38 anchored to the sewing machine base. The arrangement and disposition of the spring 37 is such as to tend to draw the support tube 31 in a rearward direction and to rotate it in a direction to urge the feeding head 29 downward toward the button in the feed bracket 19.

An actuating rod 39 is slideably and rotatably supported at one end in a bearing bracket 40 and extends forward through the sleeve 35 and through the support tube 31 up to the feeding head 29. At its forward end, the actuating rod forms a rack 41, which engages the gear 30 and is adapted to rotate the gear 30 and the pinion 28 upon relative sliding movement of the actuating rod 39 with respect to the support tube 31.

The normal position of the actuating rod 39 within the support tube 31 is established by a stop pin 42 anchored in the actuating rod 39 and extending through an elongated slot 43 in the sleeve 35. A spring 44 is anchored at its forward end to the sleeve 35, by means of the pin 36, and at its rearward end to the actuating rod 39, by means of a pin 45. Accordingly, the normal position of the actuating rod is determined by the pin 42 engaging the forward end of the slot 43.

The function of the button feeding mechanism, as thus far described, is as follows: The springs 37 and 44 initially hold the support tube 31, feeding head 29 and actuating rod 39 in the position illustrated in FIG. 3, it being assumed at this stage of the explanation that the button directly underneath the feeding head has been engaged by orienting pins and is properly rotationally oriented. When it is time to feed a new button into the sewing position S, the actuating rod 39 is driven forward (by means to be described) until the stop collar 34 engages the bearing block 32. The button engaged by the orienting pins is carried forward in the feed bracket 19 and is snapped into place in the clamp 23. At this time, the support tube 31 and actuating rod 39 are rotating slightly (by means to be described) to lift the feeding head 29 and withdraw the orienting pins from the thread holes 27 of the button now in the sewing station S. By means of the spring 37, the support tube 31 is retracted until the forward stop collar 33 engages the bearing block 32. The spring 37 also at this time urges the orienting pins downward onto a new button, which has in the meantime been advanced along the feed bracket 19 into the load position L. Proper engagement of the new button by the loading head and orienting pins is achieved by a momentary rearward reciprocation of the actuating rod 39, against the spring 44. Since the support tube and loading head are stopped by the collar 33, the actuating rod 39 moves relative to the support tube and causes rotation of the gear 30 and pinion 28 and, of course, corresponding rotation of the orienting pins. Assuming that the orienting pins have not initially entered the thread openings 27 in the button, they will do so after a short initial rotation of the pinion 28, whereupon the spring 37 causes the loading head 29 to drop down toward the button and mechanically engage the button with the orienting pins. Return movement of the actuating rod 39 is effected by the spring 44, which rotates the gear 30 and pinion 28 back to a predetermined starting orientation, in which the orienting pins, and therefore the button 21, will be properly rotationally oriented in preparation for a subsequent sewing operation. In this respect, forward movement of the actuating rod 39 is always limited by engagement of the pin 42 and slot 43, so that repetitively precise rotational orientation of the button is assured.

The various above described motions of the button feeding and orienting mechanism are achieved, in accordance with the present invention, by means of a pair of pneumatic actuators 50, 51. The actuator 50 is a double acting unit, having air lines 113, 111 leading to each end of the cylinder, and having a forwardly extending operating rod 54 engaging a drive arm 55 through a spherical bearing member 56. The closed end of the actuator 50 is secured to the frame of the sewing machine, also by a spherical or other bearing 57, which will accommodate at least limited movement of the actuator about multiple axes. The drive arm 55 may be welded or otherwise secured to a collar 55 fixed to the actuating rod 39.

Advantageously, the operating rod 54 of the actuator 50 has an extension 59, which has a sliding fit with the spherical bearing 56 on the drive arm. Forward and rearward stop collars 60, 61 are secured to the rod extension 59, on opposite sides of the bearing 56, preferably with some clearance at each side.

When both ends of the feed actuator 50 are deactivated, the button feeding mechanism is retained in its normal position, as shown in FIG. 3, and the piston 62 of the actuator 50 will be more or less centered within the cylinder, being moved to such position by return of the drive arm 55 and bearing 56 to normal positions, under the influence of the springs 37, 44.

Forward feeding of a button from the load position L to the sewing position S is effected by admitting fluid pressure into the closed end of the actuator 50 through air line 111. As will be further described, forward energization of the actuator 50 is only momentary, sufficient to drive the support tube 31 forward to its limit stop, after which the support tube is rotated slightly to upwardly tilt the loading head 29 and free and just-delivered button. As the closed end of the actuator 50 exhausts, following its momentary actuation, the spring 37 returns the support tube 31 to its normal position.

At some point in the cycle, prior to the next button delivery operation, the rod end of the actuator 50 is energized by admitting pressure fluid into the line 113 to effect a momentary retraction of the operating rod 54. This serves to retract the actuating rod 39 against the spring 44, to effect pin engagement with a button as heretofore described. Following the momentary energization and exhausting of the rod end of the actuator 50, the actuating rod 39 is returned by the spring to its normal position, with a new button now being engaged and oriented by the loaded head 29.

Figure 4:
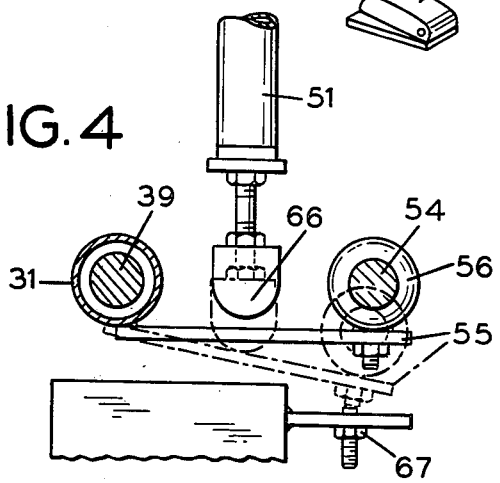
FIG. 4 is a fragmentary cross sectional view as taken generally on line 4—4 of FIG. 3.
Figure 2:
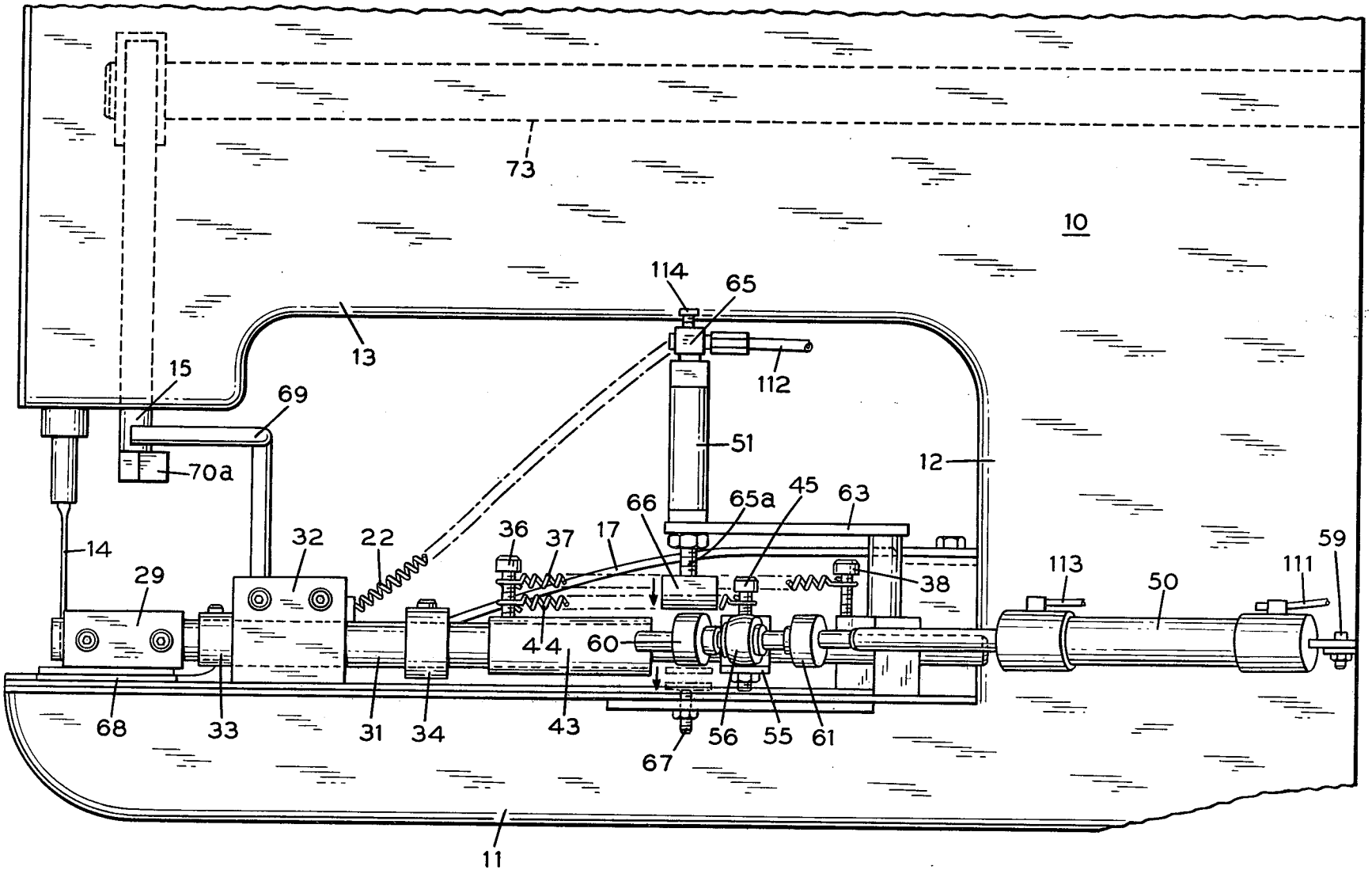
FIG. 2 is a side elevational view of the apparatus of FIG. 1.

Properly timed rotation of the support tube 31 and corresponding upward tilting of the loading head 29 is achieved by means of a single acting, spring returned air cylinder 51, which is mounted vertically on the machine, by means of a support bracket 63. The upper or closed end of the actuator 51 is connected through a fluid line 112 and metering valve 65 to a controlled source of pressure fluid, as will be further described. Location of the actuator 51, which may be referred to as the tilt actuator, is generally directly above the forward-actuated position of the drive arm 55 (as shown in phantom lines in FIG. 3). Accordingly, when the feed actuator 50 is energized forwardly, advancing the drive arm 55 to its forward position to deliver a button into the sewing position, the tilt actuator 51 is energized to extend its operating rod 65*a* downward. A pusher bar 66 carried by the operating rod 65*a* engages the forwardly advanced drive arm 55 and pushes it downward, as shown in FIG. 4, rotating the actuating rod 39, sleeve 35 and support tube 31 and lifting the loading head 29 in the desired manner. A suitable adjustable limit stop 67 (FIG. 4) may be provided to limit the amount of rotation of the support tube 31.

As reflected in FIG. 3, the length of the pusher head 66, in a direction parallel to the actuating rod 39, is somewhat less than the actuating stroke of that rod during the forward movement in delivering a button. Thus, on the return or rearward movement of the actuating arm 39, the drive arm 55 will clear the pusher head 66 and be permitted to rotate in a return direction under the influence of the spring 37. The length of the pusher head 66 is sufficient to retain the loading head 29 in its tilted or raised position until it has cleared the just-delivered button and is positioned over the top of a new button in the load position.

In a normal button-sewing cycle, the fabric on which the button is to be sewed is clamped in the sewing machine prior to commencement of sewing. This is accomplished in the illustrated apparatus by means of the spring 17, which presses a clamping foot 68 (FIG. 2) downward onto the fabric part. At the conclusion of the sewing cycle, the presser foot lift bar 15 is raised, as a normal part of the sewing cycle. In the illustrated apparatus, a lifting finger 69 extends upward from the button feed bracket 19 and overlies an arm 70*a* of the presser foot lift bar. Thus, when the bar 15 is raised, at the conclusion of sewing, the clamping foot 68 is lifted to free the completed article with the attached button. Before commencement of the next cycle, a new piece of fabric is inserted under the clamping foot, and the cycle commences with the lowering of the presser foot lift bar 15, allowing the spring 17 to bring the clamping foot 68 into engagement with the fabric.

Figure 5:
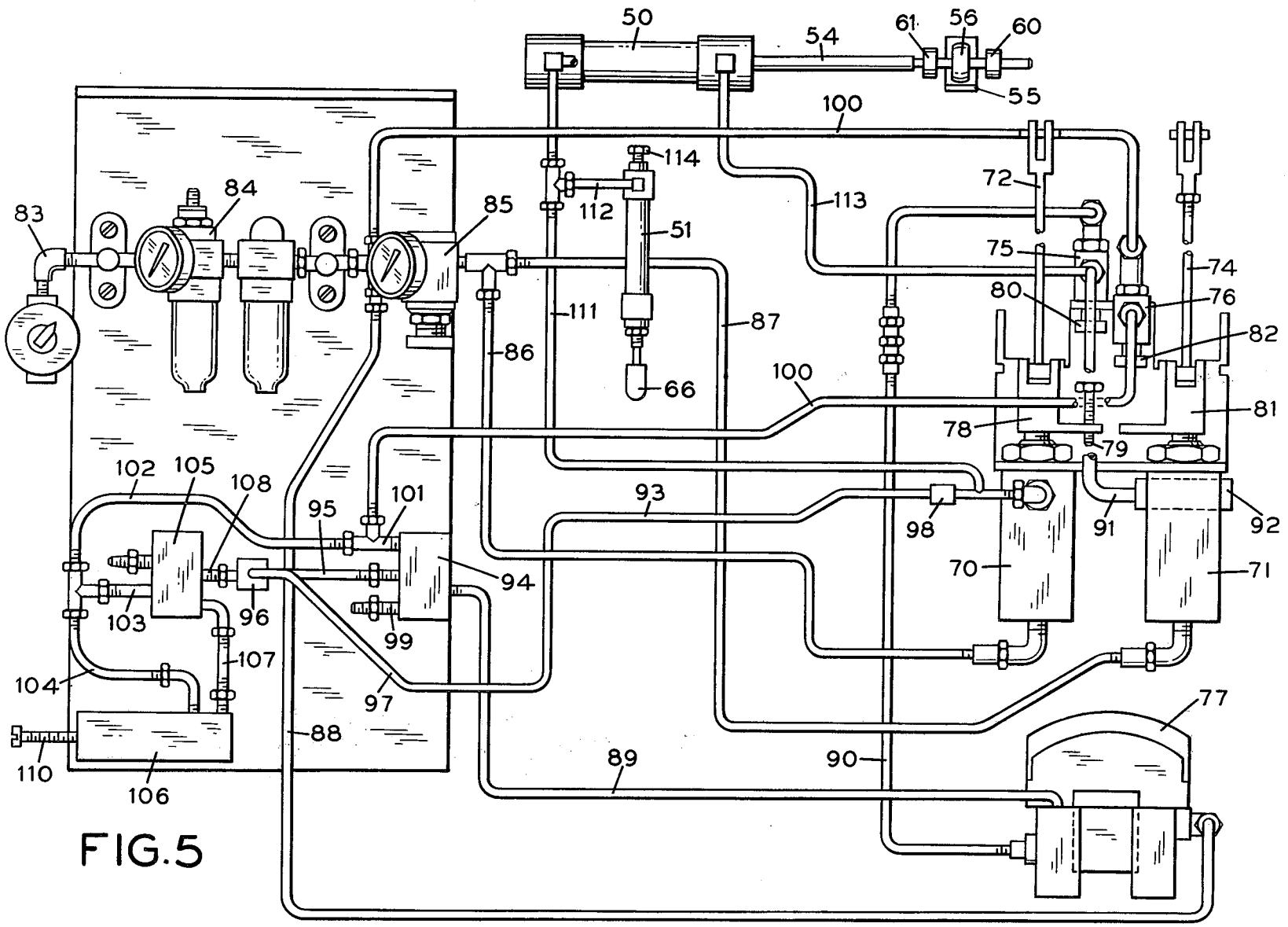
FIG. 5 is a simplified, schematic piping diagram illustrating a novel manner of incorporating sequenced pneumatic actuation of the button mechanism into the primary pneumatic actuation of the sewing machine.

Pursuant to an important aspect of the invention, a unique and simplified arrangement is provided for associating and synchronizing the operations of the feed and tilt actuators with the functions of the sewing machine during the sewing cycle. A particularly advantageous arrangement is made possible by the invention when incorporated with a sewing machine of the general type reflected by Singer Model 421, W307BA (hereinafter referred to as Model 421), which are widely used for industrial sewing. The Model 421 sewing machine is conventionally provided at the back with a pair of pneumatic actuators 70, 71 (FIG. 5) which may be referred to respectively as the clamp and clutch cylinders. The clamp cylinder 70 is provided with an upwardly extending operating rod 72 which operates (by conventional means not shown), a drive shaft 73 (FIG. 2) operating the presser foot lift bar 15. The arrangement is such that, when the clamp cylinder operating rod 72 is extended (raised) the presser foot lift bar 15 is lowered, serving in the instant case to lower the clamping foot 68 onto the work. The clutch cylinder 71 has an operating rod 74 which, in the commercial form of the Model 421 sewing machine is connected to a clutch-brake mechanism of the sewing machine. When momentarily actuated in an upward or extending direction, the operating rod 74 serves to release the sewing machine brake and simultaneously engage a clutch, connecting the drive motor to the sewing mechanism. The standard commercial sewing machine further includes a mechanical cam type lock (not shown) which retains the clutch operating rod 74 in an extended condition, regardless of the application of fluid pressure in the return direction, until a complete sewing cycle has been concluded. At that time, fluid pressure, previously applied to the upper end of the clutch cylinder 71, is effective to retract the mechanically released operating rod 74 to conclude the sewing cycle.

As part of the standard equipment of the Model 421 sewing machine, the clamp and clutch cylinders 70, 71 are associated with crossover valves 75, 76, which are three-way fluid valves arranged to be actuated by upward or extending movements of the respective operating rods 72, 74 and cross connected to the respective cylinders. Thus, upward movement of the clamp cylinder rod 72 will effect actuation of the crossover valve 75, which is connected to the clutch cylinder 71, and upward movement of the clutch cylinder rod 74 will effect actuation of the crossover valve 76, which is cross connected to the clamp cylinder 70.

In general, in the operation of a standard, conventional Model 421 machine, a foot valve 77 is depressed by an operator to commence a sewing operation. This results in exhausting fluid under relatively high pressure from the upper end of the clamp cylinder 70, causing the operating rod 72 to extend under the influence of low pressure constantly applied to the closed end of the cylinder. In a conventional machine, this would serve to lower the presser foot. Extension of the cylinder 70 raises a bracket 78 carrying a pedestal bolt 79 arranged for engagement with an operator 80 for actuating the three-way crossover valve 75. Thus, when the clamp cylinder 70 is fully extended, which in the illustrated system serves to lower the presser foot support 15, the clamping foot 68 is also lowered. As the clamping operation is completed, the crossover valve 75 is actuated to effect momentary retraction of the initially extended clutch cylinder rod 74. This is mechanically held in a retracted position until the end of a sewing cycle, after which it is mechanically released and allowed to extend. At that time, a bracket 81 carried with the rod 74 engages a valve actuator 82 for the second crossover valve 76. This admits pressure to the upper end of the clamp cylinder 70 releasing the fabric and ending the cycle of operations.

As thus far described, the fluid operating system is a standard part of the conventional Model 421 sewing machine. Pursuant to the invention, unique and advantageous utilization is made of the existing control functions of the Model 421 machine such that, by judiciously tapping off of the existing control pressures, the button feed actuator 50 and the tilt actuator 51 may be caused to operate in desired synchronism with the other functions of the sewing machine, with a practical minimum of added control components. With reference still to the schematic diagram of FIG. 5, a regulated source of air under pressure is derived from an air supply line 83 leading through a main pressure regulator 84. This air, which may be at a pressure of, say, 60 psi, may be considered as the primary control air. Secondary control air, at a lower pressure of about five psi, is derived from a second pressure regulator 85. The secondary control air is led through fluid lines 86, 87 to the closed ends of the clamp and clutch cylinders 70, 71 respectively, and provide a constant upward pressure bias on those cylinders. Primary air, at the higher pressure, is led through a fluid line 88 to the inlet side of the foot valve 77. The foot valve incorporates a pair of three-way valves (not specifically illustrated) connected respectively to outlet lines 89, 90. The outlet line 89 is connected to a normally open valve and is normally under primary pressure. The outlet line 90 is connected to a normally closed valve, and is normally exhausted.

The normally exhausted outlet line 90 is connected to the inlet side of the first crossover valve 75 and, through that valve, is connected by means of a fluid line 91 to a one-shot pulse valve 92, which in turn is connected to the upper or rod end of the clutch cylinder 71.

When the foot valve 77 is depressed, pressure is admitted to the fluid line 90 and thus to the inlet side of the crossover valve 75. The crossover valve is normally closed and does not admit fluid to its outlet line 91. However, when the crossover valve is actuated, by upward movement of the clamp actuator rod 72, pressure fluid is admitted to the line 91 and one-shot pulse valve 92. This serves to admit a single pulse of high pressure air to the upper end of the cylinder 71. This high pressure air overcomes the lower pressure bias at the closed end of the cylinder, retracting the cylinder rod 74 until it is mechanically locked by the sewing machine mechanism. During the sewing cycle, the upper end of the clutch cylinder 71 is exhausted through the one-shot valve 92, permitting return of the arm 74 when mechanically released by the sewing machine.

When the foot valve 77 is depressed, pressure is exhausted from the line 89. Through a system of valves to be described, and the purpose of which it is to provide for automatically repetitive operation of the system, pressure is at this time also exhausted from the fluid line 93 leading to the upper end of the clamp cylinder 70, causing that cylinder to extend and, eventually, to actuate the crossover valve 75.

In the illustrated control system, including the automatic repeat feature, the outlet line 89 from the foot valve is connected to a control valve 94. The control valve is also connected to a line 95 and through a Tee fitting 96 to a fluid line 97 connected to the line 93 leading to the upper end of the clamp cylinder 70. Also connected in the line 93 is a so-called dump valve 98 which is operative, when pressure is being exhausted from the line 93 to "dump" or rapidly exhaust the upper end of the clamp cylinder. Thus, in the illustrated system, when pressure is relieved from the line 89 by the foot valve 77, the valve outlet line 95 is connected through the control valve 94 to a restricted exhaust outlet 99. However, as soon as a partial loss of pressure has been realized in the line 93, the dump valve 98 will actuate to rapidly exhaust the balance.

In the illustrated system, the inlet side of the second crossover valve 76 is supplied with primary (high pressure) air through a line 100. Initially, at the start of a sewing cycle, the crossover valve 76 is in an actuated condition, as a result of the normally extended position of the clutch cylinder rod 74. Accordingly, high pressure fluid is in the outlet line 100, leading from the crossover valve 76. The line 100 is connected at 101 to the control valve 94, and is also connected through lines 102, 103 and 104 to a control valve 105 and a metering valve 106 respectively. The outlet side of the metering valve 106 is connected through a line 107 to a control port of the valve 105. An outlet port of the valve 105 is connected through line 108 to the Tee fitting 96 and thus to the upper end of the clamp cylinder 70. Initially, the control valve 105 is closed at the start of a sewing cycle, so that high pressure fluid does not flow into the line 97.

At the commencement of a cycle of operations, after the clamp cylinder 70 has been extended following operation of the foot valve and the first crossover valve 75 has been actuated to retract the clutch cylinder 71, the second crossover valve 76 is deactuated and closed. Pressure in the line 100 and in the lines downstream thereof is permitted to bleed off. When the sewing cycle is completed, and the clutch cylinder rod 74 is mechanically released and permitted to extend, the second crossover valve 76 is reactuated, admitting pressure fluid into the lines 100 and 102–104. Primary pressure is thereupon admitted to the upper ends of the clamp cylinder 70 through the control valve 94. This retracts the clamp cylinder to its normal, starting position and releases the fabric from underneath the clamping foot 68. A new cycle can be started by subsequently depressing the foot valve 77.

If a continuing sequence of sewing cycles is desired, the foot valve 77 is held in a depressed condition, maintaining the outlet line 89 therefrom connected to exhaust. Under these conditions, when the sewing cycle is completed and the clutch actuating rod 74 mechanically released and extended to actuate the crossover valve 76, primary pressure is admitted to the upper end of the clamp cylinder 70 through the control valve 105, entering through the inlet line 103 and passing through the outlet line 108 into the Tee fitting 96. At the same time, primary pressure flows to the metering valve 106 and out into the metering valve outlet line 107 at a controlled rate. When full primary pressure is established in the line 107, after a predetermined time delay, the control valve 105 is closed and the primary pressure begins to bleed from the upper end of the clamp cylinder 70, actuating the quick dump valve 98 and initiating an entire new cycle. The time delay introduced by the valve 106 is controllable by metering control 110, to establish a sufficient time delay for the operator to remove the sewed button from the button clamp and either reposition the fabric for sewing of an additional button thereon or to introduce a new piece of fabric into sewing position.

In accordance with a significant aspect of the invention, the button feed actuator 50 and tilt actuator 51 are connected into the air actuating and control system for the sewing machine in such manner as to achieve the various button feeding and orienting operations in an automatically timed sequence with the sewing machine functions, without the need for additional complicated sequencing controls. To this end, the closed end of the button feed actuator 50 is connected by an air line 111 to the upper end of the clamp cylinder 70, between the cylinder and the dump valve 98. Thus, at the commencement of a cycle of sewing operations, when the upper end of the clamp cylinder 70 is pressurized, the closed end of the button actuator is also pressurized, holding the button feeding head 29 in an advanced position. In addition, the upper or closed end of the tilt actuator 51 is connected by a line 112 to the line 111, so it too will be pressurized and extended, such that the loading head 29 will be in an upraised position, with the orienting pins withdrawn from the previously delivered button.

Upon operation of the foot valve 77, resulting in pressure dumping from the upper end of the clamp cylinder 70, the clamping foot will be lowered, along with the just-delivered button. The loading head 29 will be withdrawn by the action of the return spring 37 and, upon clearing underneath the presser bar 66, will also rotate back to its normal position, ready to engage a new button. Exhausting of the line 111 will also, but at a slower rate, exhaust the upper end of the tilt cylinder 51 allowing it to retract.

The forward end of the button feed actuator 50 is connected via an air line 113 to the upper end of the clutch cylinder 71. Accordingly, after initiation of the operating cycle and completion of the clamping operation by upward extension of the cylinder rod 72, the crossover valve 75 is actuated, followed by actuation of the one-shot pulse valve 92. This serves momentarily to retract the clutch actuator rod 74, engaging the drive clutch to commence sewing of the button. This same one-shot pulse of primary pressure is directed through the air line 113 and serves to momentarily retract the actuator rod 39 of the button mechanism. As previously described, this results in a momentary rotation of the pinion 28 and orienting pins, first in one direction and then the other, to engage a button and rotationally orient it in the desired manner. The button is at that stage engaged, oriented and ready for loading.

Assuming there is to be a continued series of sewing operations, with the foot valve 77 remaining depressed, termination of one sewing operation, by mechanical release of the clutch operating rod 74 results in repressurizing the upper end of the clamp cylinder 70. This lifts the clamp from the just-sewed article and enables it to be withdrawn with the sewed on button. At the same time, primary pressure is directed through the lines 111, 112, extending the button feed actuator 50 to deliver the newly engaged and oriented button. The tilt actuator 51 is likewise actuated, but after a predetermined delay established by adjustment of a metering screw 114. The metering screw is set to permit the drive arm 55 to move underneath the pusher bar 66, and for the feeder head 29 to complete its forward advance, so that the button is properly positioned in the sewing station S before the feeding head is disengaged.

As will be apparent, the installation and operation of the button feed actuating system, comprising the button feed actuator 50 and the tilt actuator 51 is made extraordinarily simple and economical by effective utilization of the control pressures otherwise conventionally utilized in operating the sewing machine. The initial release of pressure from the upper end of the clamp cylinder 70 is utilized for retraction of the button feed mechanism and the tilt mechanism, leaving a just-delivered button exposed in position ready for sewing. A one-shot pulse of air, utilized to commence mechanical sewing operations, is also utilized to advantage to effect a one-shot reciprocation of the actuating rod 39, for engagement and orientation of a new button during sewing of a preceding button. Then, when the sewing operation is mechanically concluded, repressurization of the upper end of the clamp cylinder is utilized to deliver a new, oriented button to the sewing station and thereafter, in sequence, to tilt the feeding head and disengage the button. The sequencing of the tilt actuator 51 is done independently of the conventional sewing machine controls, by the simple expedient of a metering valve 114 in the inlet to the tilt actuator 51.

In the arrangement described in FIGS. 1–5, a button feeding and orienting mechanism having all of the advantageous mechanical features described in our prior U.S. Pat. No. 3,863,579, is made significantly more versatile and more economical to set up and service through the utilization of pneumatic actuators connected directly into the pneumatic actuating system for the sewing machine proper. For some relatively more simple models of sewing machine, the pneumatic actuating system of the Model 421 may not be available. Nevertheless, it is still possible to make advantageous use of a pneumatically actuated button feeding and oriented mechanism of the type described in FIGS. 1–4 by appropriately deriving pneumatic signals from mechanical functions of the sewing machine. A particularly advantageous arrangement for this purpose is reflected in FIGS. 6 and 7. In FIG. 6, the reference numeral 200 designates generally a conventional commercial sewing machine such as a Singer Model No. 275 machine. In FIG. 6, only the pedestal 201, base 202, and drive box 203 are shown, it being understood of course that the sewing machine 200 includes the principal operating components shown in FIGS. 1–4, including a button orienting and feeding mechanism and button feed and tilt actuators 50, 51 respectively therefor.

With the Model 275 machine, a sewing cycle is commenced by depressing the foot control 204 which serves, by means not shown but forming part of the sewing machine mechanism, to lower the clamp and engage the drive clutch. The sewing cycle is controlled by a timing cam 205 which cooperates with a control lever 206 such that, after commencement of a sewing cycle, the cam 205 goes through a single revolution until the follower reel 207 on the control arm 206 drops into a notch 208 on the control cam to terminate the cycle.

Pursuant to the invention, the pneumatic control system for use in connection with the Model 275 machine advantageously includes a line source **208*a* of air under pressure, passing through a regulator 209 and into a four-way valve 210. Alternate outlets from the four-way valve 210 are lines 211 and 212 respectively, one of which is pressurized and the other exhausted, depending on the actuated condition of the four-way valve. The outlet line 211 is connected to a one-shot pulse valve 213, and the outlet of that valve is connected through a line 214 to the closed end of the button feed actuator 50 and, through a line 215 and metering valve 216, to the closed end of the tilt cylinder 51. The outlet line 212 is connected to a one-shot pulse valve 217, and the outlet of that valve is connected through a line 218 into the rod end of the button feed actuator 50**.

At the commencement of a sewing cycle, with the Model 275 type machine, the foot actuator 204 is depressed, mechanically engaging the sewing machine mechanism and commencing rotation of the cam 205. This immediately lifts the control lever 206 out of the cam notch 208, initiating sewing operations through control shaft 219. At the same time, by means of a bracket 220, mounted on the sewing machine control lever 206, the four-way valve 210 is actuated to pressurize the line 212 and admit a pulse of air to the rod end of the actuator 50, through line 218. This serves to momentarily retract the drive arm 55, and with it the actuating rod 39, and this operates to effect engagement and orientation of a new button, as previously described.

Throughout the sewing cycle, the sewing machine control lever 206 is mechanically held in its lifted position by the circular surface of the cam 205. After completion of the sewing cycle and release of the clamping foot, the control cam 205 completes its cycle, and the follower 209 drops back into the notch 208. Mechanically, this disengages the sewing machine drive and terminates the sewing machine cycle. At the same time, the rocking of the control lever 206 actuates the four-way valve 210 to its second operating condition, relieving pressure from the line 212 and admitting working pressure to the line 211. This results in a one-shot pulse of fluid pressure from the valve 213, entering the lines 214, 215. This pressure pulse enters the closed end of the button feed cylinder 50, momentarily extending the actuator rod 54 and advancing the support tube 31 and feeding head 29, to bring a new button into the sewing position. Simultaneously, the pressure pulse is admitted into the upper end of the tilt actuator 51, through the metering valve 216. The rate of fluid admission through the metering valve 216 is such that the tilt actuator 51 becomes operative to tilt the feeder head 29 after the new button has been delivered to the sewing station and before the return movement of the feeder head has commenced. In practice, this is just a momentary delay, as the forward actuation of the support tube 31 is virtually instantaneous.

In either of the forms of the invention, the button feeding mechanism of the type described in our before mentioned patent is made more universally applicable to a variety of industrial sewing machines, with a minimum of modification to the machines. By providing for actuation of the button mechanism utilizing simple fluid actuators, in place of cam and linkage mechanisms, attachment of the machine is rendered almost universal, notwithstanding variations from machine to machine. The simplest kinds of brackets may be utilized to anchor the fluid actuators to the sewing machine structure.

Additional and even more significant advantages may be realized in connection with sewing machines of the type utilizing a pair of fluid actuators for control of the presser foot and drive clutch. For those machines, the system of the invention enables the fluid actuators of the button mechanism to be tapped directly into appropriate lines of the existing control system, such that controlled fluid pressures already provided for in connection with sewing machine operation may also be utilized for timed, synchronized actuation of the button mechanism.

Where the sewing machine does not employ air cylinder actuation, but utilizes a cycle control cam, a simple and inexpensive modification enables a four-way control valve to be actuated from the primary control cam. This in turn controls the operation of a pair of pulse valves for properly timed operation of the fluid actuators of the button mechanism.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. An actuating system for a button feeding and orienting mechanism incorporated in a cyclically operable sewing machine, wherein the mechanism comprises (a) a button feeding head including rotatable button orienting means, (b) a forwardly movable and tiltable support for advancing said button feeding head from a load position to a sewing position, and for withdrawing said head from a delivered button, and (c) a rearwardly movable actuating member for rotating said button orienting means, said actuating system comprising (d) first fluid actuator means operatively connected to said support and to said actuating member for effecting forward operation of said support and rearward operation of said actuating member, (e) second fluid actuator means operative to tilt said support following forward operation thereof, (f) said sewing machine being of the type having a first fluid cylinder for presser foot operation and a second fluid cylinder for clutch-brake operation, (g) means for connecting said first fluid actuator means to said first fluid cylinder for forward operation of said support, and (h) means for connecting said first fluid actuator means to said second fluid cylinder for rearward operation of said actuating member.

2. An actuating system according to claim 1, further characterized by (a) said first fluid actuator means comprising a double-acting fluid actuator operable in one direction to advance said support and in the other direction to retract said actuating member.

3. An actuating system according to claim 1, further characterized by (a) means for connecting said second actuator means to said first fluid cylinder, and (b) fluid metering means associated with said second actuator means, whereby actuation thereof is delayed with respect to forward actuation of said first actuator means.

4. An actuating system for a button feeding and orienting mechanism incorporated in a cyclically operated sewing machine wherein the mechanism comprises (a) a button feeding head including rotatable button orienting means, (b) a forwardly movable and tiltable support for advancing said button feeding head from a load position to a sewing position and for withdrawing said head from a delivered button, and (c) a rearwardly movable actuating member for rotating said button orienting means, said actuating system comprising (d) first fluid actuator means operatively connected to said support and to said actuating member for effecting forward operation of said support and rearward operation of said actuating member, (e) second fluid actuator means operative to tilt said support following forward operation thereof, (f) said sewing machine including cam means for controlling cyclical operations of the machine, (g) control valve means associated with said cam means and actuated thereby at the start and end of each sewing cycle, (h) said control valve means including a first pulse valve associated with said first fluid actuator means and operable at commencement of a sewing cycle and a second pulse valve associated with said first fluid actuator means and operable at the end of a sewing cycle for effecting respectively momentary forward operation of said support and momentary rearward operation of said actuating member.

5. An actuating system according to claim 4, further characterized by (a) restricted flow means connecting said second fluid actuator means to said first pulse valve, whereby said support is tilted in predetermined delay relation to the forward operation of said support.

6. An actuating system for a button feeding and orienting mechanism incorporated in a sewing machine, wherein the mechanism comprises (a) a button feeding head including rotatable button orienting means, (b) a forwardly movable support for advancing said button feeding head from a load position to a sewing position, and (c) a rearwardly movable actuating member for rotating said button orienting means, said actuating system comprising (d) double-acting fluid actuator means connected to said actuating member and support, and operative when forwardly actuated to advance said support and when rearwardly actuated to retract said actuating member, and (e) said sewing machine having first and second fluid cylinders controllably actuatable respectively to engage fabric prior for commencement of sewing and to terminate the sewing cycle, (f) the end of said double-acting fluid actuator means operative to forwardly actuate the double-acting actuator being operatively connected to said first fluid cylinder and the end of said double-acting fluid actuator means operative to rearwardly actuate the double-acting means being operatively connected to said second fluid cylinder whereby the button feeding and orienting operations are powered by said first and second fluid cylinder and are in synchronism with cyclical operations of said sewing machine.

7. An actuating system according to claim 6, further characterized by (a) a second fluid actuator associated with button feeding and orienting mechanism for effecting withdrawal of said button feeding head from a button after a feeding operation, and (b) means for connecting said second fluid actuator to one end of said double-acting actuator.

8. An actuating system according to claim 7, further characterized by (a) fluid flow restricting means connected to said second fluid actuator whereby actuation thereof is delayed relative to actuation of said double-acting actuator.

9. In combination with a cyclically operable sewing machine having first and second fluid cylinder means controllably actuatable respectively for engaging fabric prior to commencement of sewing and to terminate the sewing cycle, (a) a button feeding mechanism for cyclically orienting and feeding buttons for sewing operations and including a button feeding head provided with rotatable button orienting means, (b) first and second fluid actuator means associated with said mechanism for effecting button feeding operations, (c) a support tube mounting said feeding head and slidably supported for advancing and return movements, (d) rearwardly movable actuating member for rotating said button orienting means, (e) said first fluid actuator means being operatively connected to said support tube and actuatable by said first fluid cylinder means to advance the button feeding head, and (f) said second fluid actuator means being operatively connected to said rearwardly movable actuating member and actuatable by said second fluid cylinder means, (g) whereby the feeding and orienting of the buttons is synchronized with operations of said sewing machine.

10. An actuating system according to claim 9, further characterized by (a) said first and second actuator means comprising opposite ends of a double-acting actuator.

11. An actuating system according to claim 10, further characterized by (a) an actuating rod slidably supported in said support tube for retracting and return movements with respect thereto, and (b) said double-acting fluid actuator being connected to said actuating rod.

12. An actuating system according to claim 11, further characterized by (a) an additional fluid actuator associated with said mechanism for controllably tilting said feeding head.

* * * * *